United States Patent [19]

Kajita et al.

[11] Patent Number: 4,464,449

[45] Date of Patent: Aug. 7, 1984

[54] RECORDING METHOD HAVING UNIFORM EXPOSURE, CHARGING, AND INFRARED IMAGE EXPOSURE

[75] Inventors: Isamu Kajita, Yokohama; Fumio Sumino, Kawasaki, both of Japan

[73] Assignee: Canon Kabushiki Kaisha, Tokyo, Japan

[21] Appl. No.: 343,951

[22] Filed: Jan. 29, 1982

Related U.S. Application Data

[63] Continuation of Ser. No. 144,217, Apr. 28, 1980, abandoned.

[30] Foreign Application Priority Data

May 4, 1979 [JP] Japan ..... 54-54887

[51] Int. Cl.[3] ..... G03G 13/22

[52] U.S. Cl. ..... 430/54; 430/94

[58] Field of Search ..... 430/54, 55; 355/14 CH, 355/94

[56] References Cited

U.S. PATENT DOCUMENTS

| | | | |
|---|---|---|---|
| 3,249,430 | 5/1966 | Metcalfe et al. | 430/54 |
| 3,533,783 | 10/1970 | Robinson | 430/54 |
| 3,558,307 | 1/1971 | Carlson | 430/54 |
| 3,709,683 | 1/1973 | Ciuttini | 430/54 |
| 4,288,514 | 9/1981 | Kutsuwada et al. | 430/54 |
| 4,366,220 | 12/1982 | Saito | 430/55 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

A method of recording information by projecting electromagnetic radiation to a recording medium, wherein a first electromagnetic radiation in a wavelength region to which the recording medium has its principal sensitivity is uniformly imparted to the recording medium, and, while the hysteresis remains, a second electromagnetic radiation a wavelength longer than said first wavelength region and which bears thereon the information to be recorded is projected onto the recording medium, thereby increasing the sensitivity of said recording medium with respect to said second electromagnetic radiation.

2 Claims, 2 Drawing Figures

RECORDING METHOD HAVING UNIFORM EXPOSURE, CHARGING, AND INFRARED IMAGE EXPOSURE

This is a continuation of application Ser. No. 144,217, filed Apr. 28, 1980, now abandoned.

BACKGROUND OF THE INVENTION

1. Field of the Invention

This invention relates to a method of recording informations on a recording medium by projecting electromagnetic radiation. More particularly, it is concerned with a recording method which is capable of performing favorable recording onto a recording medium containing therein a photoconductive substance by projecting electromagnetic radiation in a wavelength region outside that where the recording medium has its principal sensitivity.

2. Description of Prior Arts

As the method for recording information by light, there has been developed and widely used the electrophotographic method. Since this method performs the image recording by reflected light from an image original so as to be useful as an image reproduction apparatus, visible light is used in the main. In recent days, however, this electrophotographic method is also utilized in such a recording device that converts image information into electrical signals, and performs the recording with light beam controlled by the electrical signals. As an actual example of such recording device, there is such one that electrical signals are converted into light signals by means of a cathode ray tube (CRT) or a laser device, and the thus obtained light is used for the image exposure in the electrophotographic method.

In the recording device wherein the electrophotographic method and laser are combined, there is usually used a gas laser, e.g., helium-neon laser, etc. However, the laser device is extremely large in size and the image modulation is also complicated.

In contrast to this, a semiconductor laser is extremely small in size, and, moreover, does not require any external modulating device, hence the modulation can be done easily and the recording apparatus as a whole can be made small in size. However, the output wavelength of the semiconductor laser, at present, is mostly outside a wavelength region of the infrared ray, and none which is capable of emitting visible light has yet been put into practice.

Exemplifying representative photosensitive members to be used in the electrophotographic system, there are Se series, CdS series, ZnO series, and so on. These photosensitive members have, in the main, their photosensitive wavelength region in the visible light wavelength region. Therefore, in order for the photosensitive member to be sensitive to the infrared ray having a wavelength longer than the visible light wavelength region, the photosensitive member of the Se series should increase its sensitivity by forming an alloy with Te, As, and so forth. In the case of the photosensitive member of the CdS series, it is generally used by being activated with Cu or Cl. However, in order to give sufficient sensitivity with respect to the infrared ray, it is necessary to further add a trivalent metal such as In, Al, etc. It is also possible to increase the sensitivity of the photosensitive member by adding CdSe in solid-solution to CdS. In the case of the photosensitive member of the ZnO series, it is activated with a sensitized coloring substance such as Rose Bengale, bromophenol blue, Crystal Violet, Rhodamin B, and so forth. In order, however, to be sensitive to the infrared ray, it is necessary to sensitize it by adding a coloring matter such as 1,1'-diethyl-1-bromo-4,4'-quinodicarbocyanine bromide, 1,1'-diethyl-2,2'-quinotollylcarbocyanine iodide, and so on.

Thus, while it is possible to give sensitivity with respect to the infrared ray to each of these photosensitive members having their principal photosensitive wavelength region in the visible light region, the present situation is such that the sensitivity is not so high as to be satisfactory. Moreover, when the sensitivity to the infrared ray is increased by the above-described sensitizing methods, the photosensitive member tends to become generally inferior in its durability, has low resistance, and thus it becomes difficult to obtain sufficient image contrast. Also, when shortage in sensitivity of the photosensitive member is to be supplemented with a light source, the light intensity must be increased. With such increase in the light intensity, the life of the light source becomes undesirably short. The present invention has been made in view of the abovedescribed disadvantages inherent in the known types of the recording methods.

SUMMARY OF THE INVENTION

It is therefore an object of the present invention to provide an improved recording method.

It is another object of the present invention to provide an improved recording method capable of performing favorable image recording onto a recording medium containing therein a photoconductive substance with use of electromagnetic radiation in a wavelength region outside that where the recording medium has its principal sensitivity.

According to the present invention, in one aspect thereof, there is provided a recording method, in which electromagnetic radiation is projected onto a recording medium for recording, characterized in that a first electromagnetic radiation in a wavelength region where the recording medium has its principal sensitivity is uniformly imparted to the recording medium, and, while the hysteresis still remains in the recording medium, a second electromagnetic radiation which is in a wavelength region longer than the abovementioned wavelength region and which bears the information to be recorded is projected onto the abovementioned recording medium to thereby increase its sensitivity to the second electromagnetic wave.

According to the present invention, in another aspect thereof, there is provided a recording method which records information with infrared ray onto a recording medium having its principal sensitivity in a visible light wavelength region, further characterized in that visible light is uniformly irradiated onto the recording medium before irradiation of the information bearing infrared ray so as to increase its sensitivity to the infrared ray.

DESCRIPTION OF PREFERRED EMBODIMENT

Figure 1:
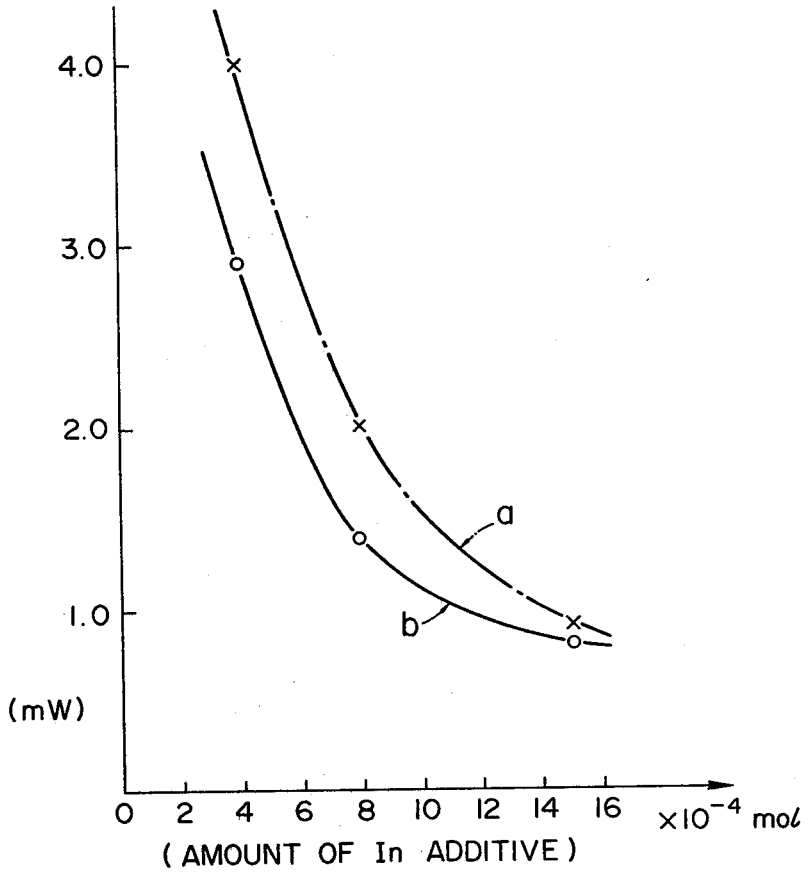
FIG. 1 is a graphical representation showing comparative characteristic curves of the recording light source output according to the present invention and that according to the conventional method.

In the following, the present invention will be explained in detail in reference to the accompanying drawing.

For the recording medium to be used for the present invention, there are various kinds such as, for instance, a photosensitive member containing therein a photoconductive substance (which is classified into the Carlson type photosensitive member with the photoconductive layer being exposed to the surface, and the NP type photosensitive member with a transparent insulative layer being coated on the photoconductive layer surface), or the so-called screen photosensitive member having a multitude of fine holes formed through the front and rear surfaces of the photosensitive member. All these photosensitive members can be effectively used.

While these various photosensitive members usually have their principal sensitivity in the visible light wavelength region, they can all be used effectively for the purpose of the present invention. Yet, even when the photosensitive member is added with a sensitizing agent to be sensitive to infrared ray, the addition of such sensitizing agent is restricted to such an extent that the photosensitive member may be able to maintain its sufficient durability.

A light source for recording information on such recording medium is, for example, a semiconductor laser having its output wavelength principally in the infrared ray wavelength region. Such light source is modulated in accordance with a recording signal and projected onto the surface of the recording medium to be made an image exposure light to the recording medium. The step for forming an image on the recording medium in accordance with this image exposure light is, of course, by utilizing an appropriate electrophotographic method depending on the construction of the abovementioned recording medium. In more detail, in the case of using the abovementioned Carlson type photosensitive member, it is subjected to a uniform charging in a predetermined polarity in advance of the image exposure. In case of the NP type photosensitive member, it is subjected to the primary charging in a predetermined polarity prior to the image exposure, then to the corona discharge having the opposite polarity component to that of the primary charging (i.e., d.c. corona discharge in the opposite polarity, a.c. corona discharge, bias a.c. corona discharge in the opposite polarity, and so on) substantially simultaneously with the image exposure. Further, if required, an overall exposure is given to the photosensitive member.

The present invention is to record information on the recording medium with electromagnetic radiation which is in a wavelength region longer than a wavelength region where the recording medium has its principal sensitivity, and which bears information to be recorded. The present invention is to further impart uniformly to the recording medium the first electromagnetic wave which is in the wavelength region where the recording medium has its principal sensitivity, before irradiation of this electromagnetic wave bearing thereon the informations to be recorded.

In case the recording medium is the photosensitive member having its principal sensitivity in the visible light region as mentioned in the foregoing example, a visible light such as fluorescent lamp, tungsten lamp, etc. is used for the first electromagnetic radiation. A favorable range of the light amount is from 10 to 10,000 lux, and a more specific range of from 200 to 1,000 lux is particularly suitable, although if depends on the characteristics of the photosensitive member to be used. The present invention causes the informations for recording to be carried on the infrared ray, not on the visible light so that they may be recorded on the photosensitive recording medium having its principal sensitivity in the visible light wavelength region. And, in recording the informations on this recording medium by projecting the information bearing infrared ray, attempt is made to increase the sensitivity of the recording medium with respect to the infrared ray by uniformly irradiating a visible light onto the recording medium prior to irradiation of the information bearing infrared ray, after which the information on the abovementioned infrared ray are irradiated onto the recording medium, while the state of its excitation due to the uniform infrared ray irradiation still remains (usually from 0 to 1.0 second depending on the recording medium).

FIG. 1 is a graphical representation of the characteristic curves showing the changes in the light source output required for obtaining one and the same bright portion potential in the case of the recording by the present invention and in the case of the conventional method. In the illustrated example, indium (In) is added to the CdS photosensitive member. In the graph, the abscissa denotes the mol number of indium added to 1 mol of CdS, and the ordinate represents, in terms of energy (mW) per unit area ($cm^2$) of the surface of the photosensitive member, the output of the light source to obtain one and the same bright portion potential with the photosensitive member at every adding quantity of indium. The curve a shows the characteristic attained by the conventional method which is shown for the purpose of comparison with the present invention. The curve b is the characteristic attained by the method of the present invention. In the illustrated example, the laser beam of 850 nm is used for irradiating the photosensitive members, each having different amount of indium added. In the case of the present invention (the curve b), a visible light of 500 lux is irradiated for 0.2 sec. in advance of irradiation of the laser beam.

As mentioned in the foregoing, the photosensitive member which has been sensitized to the infrared region definitely increases its sensitivity and becomes able to record the information with less light, while its durability has considerably decreased and its practicability has become extremely poor. On the other hand, with the photosensitive member of high durability and low degree of sensitization, extremely high energy is required for recording the information, and no stable operation of the recording device over a long period of time can be expected when the element such as the semiconductor laser source is utilized. However, with the photosensitive member added with indium (In) in an amount of $4\times10^{-4}$ mol. as shown in the drawing, the required energy can be sufficiently 3 mW in accordance with the present invention, while the image formation is difficult in the conventional method unless the energy is usually 4 mW. In particular, a difference in energy of 1 mW in the region near the limit of stable operation of the semiconducted laser source constitutes a boarder line to determine whether the image formation is practicable or not. The persons skilled in the art are very well aware of the extreme importance of such difference in the energy. Thus the present invention can exhibit remarkable effects such that the photosensitive member of high durability, which has so far been difficult to be used, can be used sufficiently practically in a region of stable operation of the semiconductor laser light source in conjunction with an advantage that the output from the light source can be simply made small. In the case of the abovementioned photosensitive member, its durability is so high that the image contrast of the reproduced images lowers to the least extent even after reproduction of as many as 100,000 sheets. Thus, by making it possible to use such photosensitive member, there is such an effect that stable recording can be maintained over a long period of time.

Figure 2:
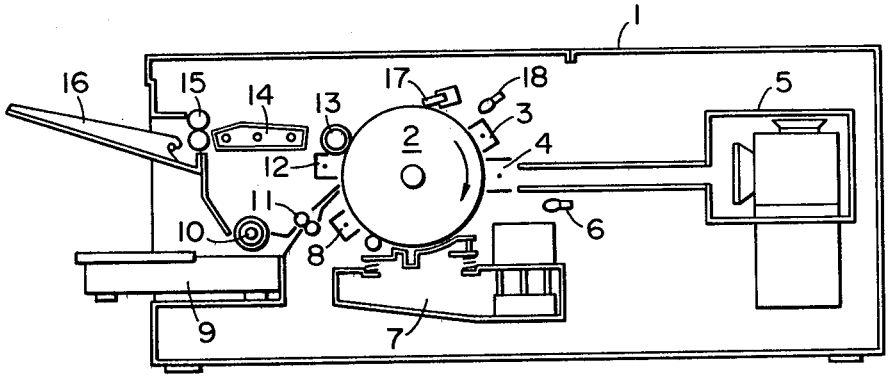
FIG. 2 is a schematic cross-sectional view of an actual recording device to practice the method of the present invention.

FIG. 2 is an explanatory diagram of an actual recording device which adopts the method of the present invention. As illustrated, the photosensitive drum 2 is supported within the housing 1 of the recording device in a manner rotatable in the direction of an arrow mark, and is rotated by a drive means (not shown). In the illustrated embodiment, the photosensitive member on the photosensitive drum 2 is the so-called "NP photosensitive member" basically constructed with an electrically conductive layer, a photoconductive layer, and an insulative layer. Around the photosensitive drum 2, there are disposed the latent image forming means which comprises the primary corona discharger 3 to apply corona discharge in a predetermined polarity to the surface of the photosensitive member, the secondary corona discharger 4 which applies corona discharge having a polarity opposite to that of the primary corona with the rear surface of the photosensitive member being optically opened, the overall exposure light source 6, and so on.

A reference numeral 5 designates the laser light source to irradiate the laser beam which has been modulated by a recording signal modulating means (not shown). A numeral 7 refers to a developing device to feed the developing agent onto the surface of the photosensitive member. The illustrated embodiment shows use of a liquid developing device. A reference numeral 8 designates a post-corona discharger which serves to squeeze out excessive quantity of the liquid developer on the surface of the photosensitive member and to adjust the surface of the photosensitive member which bears thereon a developed image to an appropriate condition for effecting the image transfer. A numeral 9 refers to a paper feeding cassette which accommodates therein the image transfer material, 10 a transfer material forwarding roller, and 11 timing rollers. A reference numeral 12 designates an image transfer corona onto the image transfer material fed from the paper feeding cassette 9 from its rear surface. 13 refers to a separation roller which separates the image transfer material which has completed the image transfer operation from the surface of the photosensitive drum in cooperation with a separation belt (not shown). 14 designates an image fixing device which works to fix the transferred image on the image transfer material. 15 denotes forwarding rollers, and 16 represents a tray to receive therein the image transfer material after the image fixation.

A reference numeral 17 designates cleaning means to clean the surface of the photosensitive drum after completion of the image transfer. In the illustrated embodiment, this cleaning means is a cleaning blade made of a resilient material such as rubber, etc. which is provided in contact with the surface of the photosensitive drum counter to its rotational direction. A numeral 18 refers to a light source having a wavelength of the principal sensitivity which the photosensitive member possesses, for which a fluorescent lamp, a tungsten lamp, and others are used.

In the following, explanations will be given as to the operation of the recording device of the abovedescribed construction.

Upon actuation of the drive source for the recording device, the photosensitive drum 2 starts rotation. At the same time, the light source 18 is lighted to impart a hysteresis to the surface of the photosensitive member. Subsequently, the surface of the photosensitive member is uniformly charged in a predetermined polarity by the primary corona discharger 3. In case the photoconductive layer is of an N-type, the charge applied is in the positive (+) polarity, while, in case it is of a P-type, the charge applied is in the negative (−) polarity. Thereafter, the surface of the photosensitive member is subjected to the corona discharge having an opposite polarity component by the secondary corona discharger 4. Substantially simultaneously with this secondary corona discharge, a laser beam which has been modulated in accordance with the recording signal (in particular, a laser beam having a wavelength region longer than the wavelength region where the photosensitive member has its principal sensitivity) is irradiated from the laser light source 5 to the surface of the photosensitive member. Next, the surface of the photosensitive member is uniformly exposed by the overall exposure light source 6 to thereby form a latent image having a high image contrast sufficient for the image development.

Liquid developer is fed from the developer 7 onto the surface of the photosensitive member, on which a latent image has been formed, and the latent image is visualized with the liquid developer. Excessive quantity of the developer liquid is squeezed out by the post-corona discharger 8, and the surface of the photosensitive member which bears thereon the developed image reaches an image transfer position. Just at this time, the image transfer material which has taken a matched timing with the photosensitive member by the timing rollers 11 reaches the image transfer position. By the image transfer corona which has been applied from the rear surface of the image transfer material by the image transfer corona discharger 12, the developed image on the surface of the photosensitive member is transferred onto the surface of the image transfer material. The image transfer material after completion of the image transfer operation is separated from the photosensitive drum by the separating means 13, etc., and discharged into the tray 16 through the image fixing device 14.

On the other hand, the surface of the photosensitive drum 2 is cleaned by the cleaning device 17 so as to be ready for the subsequent information recording.

In the above-described manner, the present invention makes it possible to record information on the recording medium by use of light (or electromagnetic radiation) which is in a wavelength region longer than the wavelength region where the photosensitive member has its principal sensitivity.

In the following, preferred examples are presented for better understanding of the present invention.

EXAMPLE 1

Photoconductive particles prepared by adding $1\times10^{-3}$ mol of copper (Cu) and $1\times10^{-3}$ mol of indium (In) to 1 mol of cadmium sulfide (CdS) are dispersed in a binder resin and the dispersion is coated on an aluminum substrate to a thickness of 40 microns, thereby producing the photosensitive member.

The surface of this photosensitive member is charged to −300 V by the corona charger of −6 kV, after which light irradiation of 2 $\mu J/cm^2$ is conducted to the photosensitive member from a halogen light source through each interference filter of 700, 800 and 900 nm, and then variations in electric potential on the photosensitive member surface are measured. The results are shown in Table 1 below. On the other hand, a visible light of 200 lux is uniformly irradiated for 0.2 second on the photosensitive member and, after 0.2 second lapse from the light irradiation, the surface of the photosensitive member is charged to a potential of −600 V. Thereafter, light irradiation of 2 $\mu J/cm^2$ is conducted to the photosensitive member from a halogen light source through each interference filter of 700, 800 and 900 nm, and the potential variations on the photosensitive member surface are measured.

TABLE 1

| Wavelength (nm) | Potential Variations due to Infrared Ray of Each Wavelength: No Light Irradiation Before Charging | Light Irradiation Before Charging |
|---|---|---|
| 700 | 750 | 750 |
| 800 | 500 | 600 |
| 900 | 50 | 300 |

As is apparent from the above Table 1, remarkable increase in sensitivity is attained by irradiation of a visible light before irradiation with infrared rays.

EXAMPLE 2

Photoconductive particles prepared by adding $1\times10^{-3}$ mol of copper (Cu) and $1\times10^{-3}$ mol of indium (In) to 1 mol of cadmium sulfide (CdS) are dispersed in a binder resin, and the dispersion is coated on an aluminum substrate to a thickness of 40 microns, over which a film of polyethylene terephthalate of 25 microns thick is laminated, thereby producing the photosensitive member.

This photosensitive member is subjected to the electrophotographic process as disclosed in U.S. Pat. No. 3,666,363 which comprises the primary charging, the simultaneous a.c. charge removal and image exposure, and the overall exposure. The light for use as the image exposure is obtained from a halogen light source which is caused to pass through each interference filter of 700, 800 and 900 nm to be rendered 2 $\mu J/cm^2$. The image contrast data obtained as the result are shown in (a) of Table 2 below. The surface potential contrast of an image obtained by irradiating light of 10 lux/sec. between the primary charging and the a.c. charge removal in the abovementioned process is shown in (b) of Table 2. Further, the surface potential contrast of the image obtained by irradiating light of 50 lux/sec. prior to the primary charging in the above-mentioned process is shown in (c) of Table 2.

TABLE 2

| Wavelength (nm) | Surface Potential Contrast (a) | (b) | (c) |
|---|---|---|---|
| 700 | 650 V | 600 V | 600 V |
| 800 | 450 V | 500 V | 500 V |
| 900 | 50 V | 300 V | 300 V |

As is apparent from Table 2, it is observed that the photosensitive member remarkably increases its sensitivity by irradiation of a visible light before irradiation of the infrared rays.

Thus, when information is to be recorded by irradiation of the infrared ray to the photosensitive member, it is effective to stimulate the photosensitive member beforehand with light containing a light of the optimum photosensitive wavelength of the photosensitive member. This is, of course, applicable not only to the CdS photosensitive member, but also to the Se type photosensitive member, ZnO type photosensitive member, and others.

It goes without saying that the present invention is not limited to the above-described examples alone. For example, besides the process as disclosed in the aforementioned U.S. Pat. No. 3,666,363, the electrophotographic process utilizing the photosensitive recording medium basically constructed with three layers of an insulative layer, a photoconductive layer, and an electrically conductive layer, the process as described in U.S. Pat. No. 4,071,316, other well known processes, or those well known image forming processes other than the electrophotographic method are applicable to the present invention. Further, when the photosensitive recording medium of a two-layer construction having no insulative layer is used, the well known electrophotographic process belonging to to so-called Carlson process can be applied. Needless to say, other electrostatic recording processes can also be adopted.

The present invention provides a method for recording informations by use of a sensitive recording medium not having its principal sensitivity region in the electromagnetic wave such as, for example, infrared ray, but having its principal sensitivity region in a wavelength region shorter than the electromagnetic wave region, and by causing the electromagnetic wave not in the principal sensitivity region to carry the informations to be recorded. Particularly, the present invention is to provide the recording method, wherein the first electromagnetic radiation in a wavelength region where such recording medium has its principal sensitivity is uniformly imparted to the photosensitive member to render it to be in an excited state, and, while the hysteresis remain on it, the second electromagnetic radiation which is in a wavelength region longer than the abovementioned wavelength region and which bears thereon the informations to be recorded is projected onto the recording medium, thereby increasing sensitivity to the second electromagnetic radiation not having the principal sensitivity primarily. Therefore, the method of the present invention is excellent in its durability in comparison with the conventional sensitizing method of the photosensitive member (e.g., color sensitizing method), and the contrast of the image thus formed is satisfactory. In particular, when it is desired to record informations by use of a photosensitive member having its principal sensitivity in the wavelength region of the visible light, and by bearing the informations on a radiating ray which is in the wavelength region of infrared ray, a visible light is uniformly irradiated prior to irradiation of the image by the infrared rays to increase sensitivity of the photosensitive member with respect to the infrared rays, thereby effectively performing the satisfactory information recording.

What we claim is:

1. A recording method wherein information is recorded by projecting an infrared image radiation onto a recording medium having its principal sensitivity in the wavelength region of visible light, said method comprising the steps of uniformly exposing said recording medium to visible light; charging said recording medium after said visible light exposure step; and, while hysteresis produced by the visible light exposure step still remains on said recording medium, projecting an infrared radiation onto said recording medium, wherein said infrared radiation includes the information to be recorded.

2. The recording method as set forth in claim 1, wherein said recording method is performed using a CdS type photosensitive member to which is added a metal of group III of the periodic table.

* * * * *